US005371520A

United States Patent [19]

Kubota

[11] Patent Number: 5,371,520

[45] Date of Patent: Dec. 6, 1994

[54] INK JET RECORDING APPARATUS WITH STABLE, HIGH-SPEED DROPLET EJECTION

[75] Inventor: Hidemi Kubota, Komae, Japan

[73] Assignee: Canon Kabushiki Kaisha, Tokyo, Japan

[21] Appl. No.: 38,049

[22] Filed: Mar. 29, 1993

Related U.S. Application Data

[63] Continuation of Ser. No. 779,160, Oct. 21, 1991, abandoned, which is a continuation of Ser. No. 436,053, Apr. 27, 1989, abandoned.

[30] Foreign Application Priority Data

| | | | |
|---|---|---|---|
| Apr. 28, 1988 | [JP] | Japan | 63-105777 |
| Apr. 28, 1988 | [JP] | Japan | 63-105778 |
| Apr. 30, 1988 | [JP] | Japan | 63-108234 |
| Apr. 30, 1988 | [JP] | Japan | 63-108235 |

[51] Int. Cl.[5] ..... B41J 3/045

[52] U.S. Cl. ..... 347/11; 347/68

[58] Field of Search ..... 346/1.1, 140

[56] References Cited

U.S. PATENT DOCUMENTS

| | | | |
|---|---|---|---|
| 4,393,384 | 7/1983 | Kyser | 346/140 X |
| 4,897,665 | 1/1990 | Aoki | 346/140 X |
| 4,980,699 | 12/1990 | Tanabe | 346/140 R X |

FOREIGN PATENT DOCUMENTS 52351 3/1985 Japan .

OTHER PUBLICATIONS

Driving Pressure Wave Shape for Drop Ejector, IBM Tech. Disc. Bulletin, vol. 29, No. 7, Dec. 1986, pp. 2922–2923.

*Primary Examiner*—Joseph W. Hartary

*Attorney, Agent, or Firm*—Fitzpatrick, Cella, Harper & Scinto

[57] ABSTRACT

An apparatus discharges ink droplets by use of pressure wave motion which occurs in a ink pressure chamber through shrinkage and expansion of an electromechanical transducing element provided in the ink pressure chamber having nozzles at the tip end. The shrinkage of the transducing element abruptly is caused to occur and also the shrinkage is maintained for a certain period of time, and subsequently expansion is abruptly caused to occur to release shrinkage to a certain level, and further a driving voltage to release gradually the shrinkage is applied on the electromechanical transducing element. A method of driving an ink jet head included in such an apparatus comprises generating a drive pulse that shrinks the transducing element, abruptly expands it to a certain level after a certain period of time and then gradually releases the remaining amount of shrinkage.

20 Claims, 12 Drawing Sheets

VOLTAGE (V)
100
50
0
-50
-100
y
z
20
40
60
80
100
120
140
160
180
200
220
240
TIME t (μ sec)

SHIFT AMOUNT (mm)
40
30
20
10
0
d
e
f
k
ℓ
m
g
h
p
q
s
u
v
r
n
o
i
j
20
40
60
80
100
120
140
160
180
200
220
TIME t (μ sec)

V1 WAVE CONFIGURATION

V2 WAVE CONFIGURATION

OUTPUT WAVE CONFIGURATION

V1 WAVE CONFIGURATION

V2 WAVE CONFIGURATION

OUTPUT WAVE CONFIGURATION

INK JET RECORDING APPARATUS WITH STABLE, HIGH-SPEED DROPLET EJECTION

This application is a continuation-in-part of U.S. patent application Ser. No. 07/779,160 filed Oct. 21, 1991, now abandoned, which in turn is a continuation of U.S. patent application Ser. No. 07/436,053 filed Apr. 27, 1989, now abandoned.

BACKGROUND OF THE INVENTION

1. Field of the Invention

This invention relates to an on-demand type ink jet recording apparatus which performs recording by discharging an ink as droplets from discharge openings at a tip end of a nozzle for discharging ink by the pressure generated by an electromechanical transducing element provided along the ink path of the nozzle.

2. Related Background Art

The above on-demand type ink jet recording apparatus or device, for example as shown in FIG. 13 is equipped with a nozzle tip end 502 for discharging or emitting ink at an end of an ink pressure chamber 501, and provided with a piezoelectric element 503 as the electromechanical transducing element provided in the vicinity of the nozzle tip end 502. By applying a driving voltage corresponding to The recording data on the piezoelectric element 503. The operation of steady state, expansion, steady state; or steady state, shrinkage, steady state is done, and ink is discharged as droplets by the pressurized force created in the ink pressure chamber 501. By such discharging, the flying ink droplets are attached onto the surface of a recording medium (recording paper, film, etc.) to form dots.

The driving voltage has a stand-up portion a, a constant value portion b and a stand-up portion c as shown in FIG. 18, shrinks the ink pressure chamber 501 at the stand-up portion a, and discharges ink droplets through the pressure thereby created. The constant value portion b maintains the shrunken state, the ink chamber 501 shrunk at the portion a is expanded at the portion c, and returned to the original state by expansion by the stand-up portion a at the stand-up portion c.

Next, by referring to. FIG. 17 as well as FIGS. 19 to 21, the discharging actuation of ink droplets by the driving voltage in FIG. 18 is to be described in detail.

As shown in FIG. 17, the ink pressure chamber 501 is shrunk at the stand-up portion a of the driving voltage, whereby the ink pressure in the ink pressure chamber 501 is elevated by $\Delta P$. Also, since a pressure difference occurs at the boundary faces 504 and 505 between the ink pressure chamber 501 and ink path, pressure wave motion is generated and propagated in the direction of the ink feeding port or opening 506 and the ink discharge opening (orifice) 507.

A while after shrinkage of the piezoelectric element 503, as shown in FIG. 19, the regions 508 and 509 on the sides near the ink feeding opening 506 and the ink discharge opening 507 from the piezoelectric element 503 are under pressure with values of $\frac{1}{2}\Delta P$. The length of these two high pressure portions is approximately equal to the length Q of the piezoelectric element 503. Because of the mechanical properties (mass, elastic constant, etc.) of the piezoelectric element 503, the boundary between the high pressure portions 508, 509 can not be always marked clearly as shown in FIG. 19, but they are described in this way for the purpose of convenience. The ink positioned inside of the piezoelectric element 503 under continuous shrinkage is returned at this point to the pressure (e.g. atmospheric pressure) before shrinkage.

Here, when the voltage applied on the piezoelectric element 503 becomes the stand-up portion c in FIG. 18, the piezoelectric element 503 is expanded. For this reason, the pressure of the ink positioned inside of the piezoelectric element 503 is lowered or decreased to become $-\Delta AP$ as shown in FIG. 20. Then, similarly as in the case at the moment when the piezoelectric element 503 is shrunk, two negative pressure portions 511 and 512 having a pressure of $-\frac{1}{2}\Delta P$ with the length within the ink path of Q occur as pressure waves as shown in FIG. 21. In the above description, since the constant value portion b of the driving voltage is made to have a long time period, the high pressure or positive pressure regions 508 and 509 in FIG. 19 are made to have completely left the ink pressure chamber 501. However, practically the constant value portion b is short, and therefore the regions 508 and 509 and the negative portions 511 and 512 may sometimes overlap each other. However, since these have linear characteristics, they can be considered as classified into two cases.

Whereas, the portion of the positive pressure region 509 extrudes ink through the ink discharge opening 507 to convert its wave motion energy to the motion energy of ink droplets. The positive pressure $\frac{1}{2}\Delta P$ in the region 509 will not lose the energy completely, but is weakened considerably as compared with $\frac{1}{2}\Delta P$ and reflected against the wall surface of the nozzle tip end 502 and the ink discharging opening 507 to be directed toward the ink feeding orifice 506. On the other hand, the positive pressure $\frac{1}{2}\Delta P$ in the positive pressure region 508 and the negative pressure $-\frac{1}{2}\Delta P$ in the negative pressure portions 511, 512 reciprocate within the ink pressure chamber 501. At this time, positive pressure $\frac{1}{2}\Delta P$ of the . region 508, when reflected at the ink feeding opening, is directed toward the nozzle tip end 502 direction as the negative pressure of $-\frac{1}{2}\Delta P$, while on the contrary, negative pressure $-\frac{1}{2}\Delta P$ of the negative portion 511 is directed toward the nozzle tip end 502 direction as the positive pressure (this is because the ink feeding opening 506 is an open end). On the other hand, the negative pressure portion 512 is reflected similarly at the ink discharge opening 50? to be directed toward the ink feeding opening 506.

However, in such ink jet recording method of the prior art, since the diameter d2 of the ink discharging opening 507 is sufficiently smaller as compared with the diameter d1 of the ink pressure chamber 501, the discharging opening 507 functions not as the open end but as the closed end. For this reason, the negative pressure $-\frac{1}{2}\Delta P$ of the portion 512 even after reflection is propagated as the negative pressure portion toward the ink feeding opening 506. Accordingly, the respective pressure waves of the positive pressure and the negative portions 511, 512 with negative pressures in the region 508 are reflected against the ink feeding opening 506 and the ink discharge opening 507 to move in reciprocating manner, and every time when it reaches the ink discharge opening 507, the meniscus 514 formed at the ink discharge opening as shown in FIG. 22 moves toward the direction 515 or the direction 516. The positive pressure, negative pressures 511 and 512 in the region 508 will move in reciprocating manner between the ink feeding orifice 506 and the ink discharging orifice 507 and will not stop until force is weakened.

For this reason, it takes a long time before discharging of the next ink, to worsen the frequency characteristic of the head. Also, the second droplet will be discharged when reaching the ink discharge opening 507 as the positive pressure wave, whereby the image quality is worsened. Further, when the negative pressure wave reaches the ink opening 507, air is imbibed to generate foam within the ink path, whereby ink discharging inability may be sometimes brought about.

For solving the above problems, one may consider to apply a second pulse voltage on the piezoelectric element 503. That is, the stand-up time of the second pulse voltage is made coincident with the time when the positive pressure $\frac{1}{2}\Delta P$ in the region 508 shown in FIG. 19 and FIG. 20 is reflected against the feeding opening 506 and passes through the innerside of the piezoelectric element 503 as the negative portion 517 as shown in FIG. 23, thereby cancelling the negative portion 517. However, although discharging of the second droplet can be suppressed, due to application of the second pulse voltage, two positive pressure wave motions and one negative pressure wave motion are created, and therefore it takes a long time before restoration of the meniscus, and also there is involved the inconvenience of the risk of incorporating foam.

As another method for driving an ink jet recording head of the on-demand type, there has been known, for example, the method in which a voltage is applied as shown in FIG. 24 on a piezoelectric element as an electromechanical transducing system (Japanese Patent Application Laid-open No. 62-25058). According to this driving method, the voltage as mentioned above is applied on the piezoelectric element 611 of an ink jet recording head constituted as shown in FIG. 25 by use of a circuit block 612. More specifically, first, the piezoelectric element 611 is expanded in the voltage step a, and expansion of the piezoelectric element 611 is maintained for a predetermined time period under a constant voltage b. During this time period, the meniscus 620 of the discharge opening 615 is returned slightly into the nozzle. After elapse of a predetermined time period, the piezoelectric element 611 is abruptly shrunk by the voltage step c, thereby discharging the ink droplets 614 through the orifice 615.

As the voltage waveform, the waveform as shown in FIG. 26 may be sometimes applied. This waveform has the waveform comprising the parts d, e, and f added in the process of returning to the state before actuation, which performs shrinkage and expansion of the piezoelectric element 611 so as to effect stabilization of the meniscus 620.

The driving method as described above was suitable for a recording head having a structure as shown in FIG. 25 equipped with a filter 621 at a rear end of a glass tube 622 having forming the ink path 613, which filter contributed to stabilization and early attenuation of the motion of the meniscus 620 after ink discharging by absorption of the pressure wave propagating through the ink within the ink path 613.

However, the above driving method could not be applied as such to an ink jet recording head, which is not provided with a filter 621 at the rear end of the ink path 613. Also, the above filter 621 is expensive, and also it is required to be mounted and welded at the rear end of the glass tube 622, for which a large number of steps have been required.

SUMMARY OF THE INVENTION

It is an object of the present invention to provide an ink jet recording apparatus and method which can solve such technical problems of the prior art, can discharge the ink as droplets stably and also stop quickly the motion of meniscus.

It is another object of the present invention to provide an ink jet recording apparatus and method in an on demand type ink jet recording device which discharges ink droplets by use of pressure wave motion which occurs in the ink pressure chamber through shrinkage and expansion of an electromechanical transducing element provided in the ink pressure chamber having nozzles at the tip end thereof. Shrinkage of the transducing element is abruptly caused to occur and also the shrinkage is maintained for a certain time period, and subsequently said expansion is abruptly caused to occur to release said shrinkage to a certain level.

As mentioned above, by shrinking abruptly an electromechanical transducing or converting element and also maintaining it for a certain time period, and subsequently making the driving voltage abruptly at a certain level followed by gradual release of shrinkage, generation of the positive pressure caused by migration of the negative pressure is prevented, whereby the ink droplets are made ready for the next discharging while preventing discharging of unnecessary ink droplets. Thus, deterioration of the image quality can be prevented while preventing deterioration of frequency characteristics. Incidentally, by setting the driving voltages during shrinkage and during expansion corresponding to the amount of ink discharged and the amount of shrinkage, it has become possible to determine the optimum discharging amount, and generation of complicated actuations of pressure wave motion can be prevented to effect ink discharging stably.

Also, by setting the shrinkage persistence or continuation time on the basis of the position of the electromechanical transducing element arranged relative to each of the ink feeding orifice and the ink discharging orifice, the negative pressure created by the change in driving voltage during expansion can be controlled to cancel the pressure to the extent which will not discharge unnecessary ink droplets.

For another (second) construction for achieving the above first embodiment, in a second embodiment, the driving voltage for causing shrinkage of the transducing element, maintaining this shrinkage for a predetermined time period, and then after causing the expansion of the transducing member step by step abruptly to release said shrinkage to the predetermined level is applied to the transducing member.

As mentioned above, by shrinking abruptly the electromechanical transducing member and maintaining it for the predetermined time period, and thereafter expanding it step by step and abruptly to the predetermined level, generation of the positive pressure resulting from the movement of negative pressure can be prevented, and discharge of unnecessary ink droplets also can be prevented.

Additionally, by cancelling the expansion gradually succeeding to the expansion operation, occurrence of complex pressure wave movement within the ink chamber can be prevented, so that ink discharge can be stabilized. Also, on account of varying the driving voltage in the expansion process, the discharge amount of the ink can be adjusted.

Furthermore, by determining the timing of plural expansion initiations startings based on the disposed location of the electromechanical transducing element, the negative pressure within the ink chamber generated with the expansion operation is adjusted to thereby cancel it so that unnecessary ink droplets would not be discharged.

It is another object of the present invention to provide an ink jet recording apparatus and method which can actuate stably an ink jet recording head which is not provided with the filter at the rear end of the glass tube constituting the ink path, thereby preventing discharging of harmful second droplets or entrainment of bubbles, and to provide an ink jet recording apparatus which has enabled stable discharging over a wide temperature range.

For achieving the above object, in a third embodiment, the electromechanical transducing element is expanded abruptly, maintained in that state for the predetermined time period, shrunk abruptly and maintained for the predetermined time period, and thenafter expanded abruptly by an amount corresponding to the ink temperature and gradually restored to the state before operation.

According to the ink jet recording apparatus of the present invention, the reflected wave of the pressure wave caused by shrinkage and expansion of the electromechanical transducing element can be cancelled in the step which releases shrinkage of the electromechanical transducing element. As the result, it becomes possible to drive even an ink jet recording head provided with no filter at the rear end of the ink path.

Also, since the electromechanical transducing element is abruptly expanded in an amount corresponding to the temperature of the ink, stable charging of the ink is rendered possible over a wide temperature range.

In another (fourth) embodiment for achieving the above object, the electromechanical transducing element is expanded abruptly, maintained for the predetermined time period, shrunk abruptly and maintained for the predetermined time period, expanded abruptly and restored to the state before operation.

DESCRIPTION OF THE PREFERRED EMBODIMENT

The present invention will be described in detail below with reference to FIGS. 1 to FIG. 6.

Figure 1A:
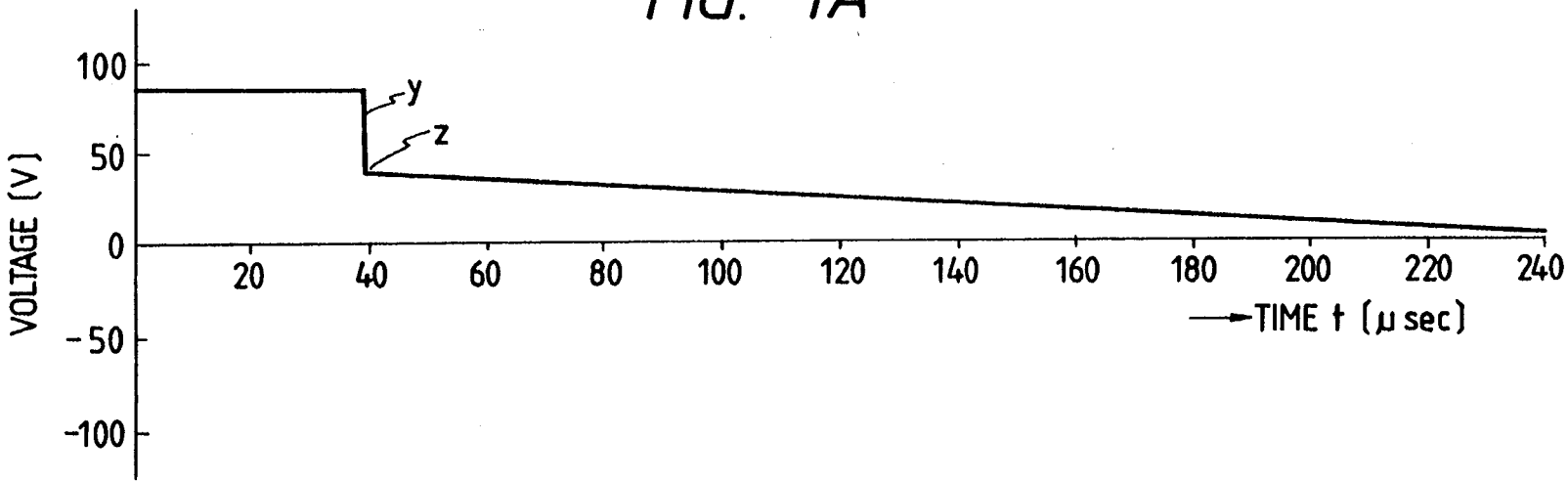
FIGS. 1A and 1B are respectively a graph showing time-voltage characteristics of a drive voltage for explaining a drive method according to a first embodiment of the present invention, and a graph showing pressure wave propagation characteristics in an ink pressure chamber.
Figure 1B:
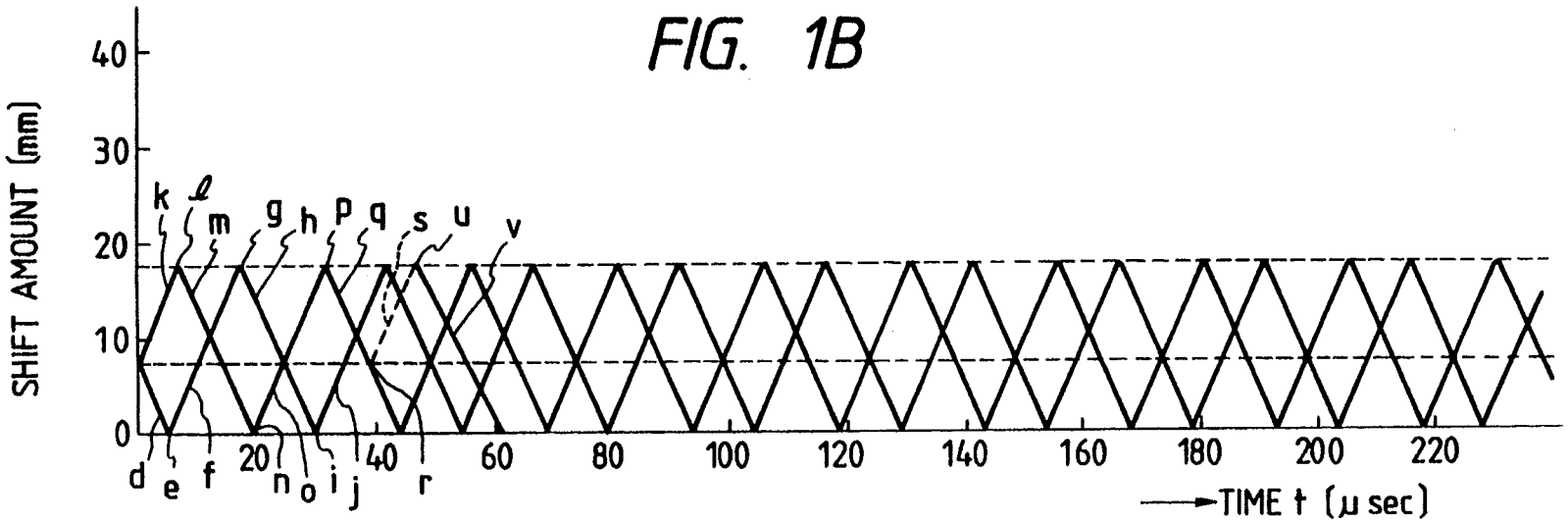
Figure 2:
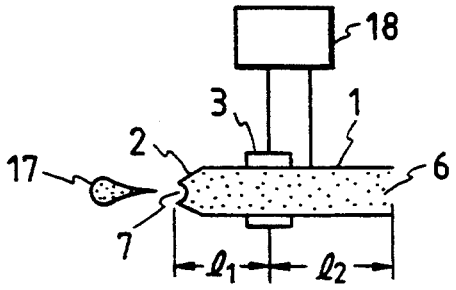
FIG. 2 is a sectional view of a head applied to the above embodiment.

FIGS. 1A and 1B are respectively a graph showing time-voltage characteristics of a drive voltage for explaining a drive method according to the present invention, and a graph showing pressure wave propagation characteristics in an ink pressure chamber. FIG. 2 is a sectional view of a head applied to the present invention.

As shown in FIG. 2, a piezolecstric element 3 mounted on an ink pressure chamber 1 is located at an intermediate portion between an ink supply opening or port 6 and an ink injection port 2, and is applied with a drive voltage from a driver 18.

Figure 19:
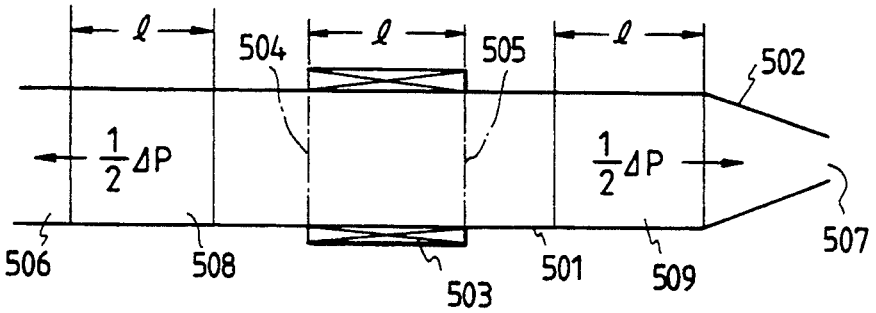
FIG. 19 PRIOR ART
FIGS. 19 to 23 are views for explaining a generation mechanism of a pressure wave in an ink pressure chamber.
Figure 20:
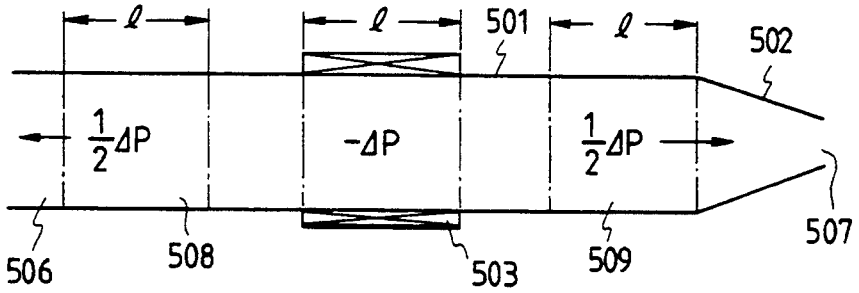
FIG. 20 PRIOR ART

As shown in FIG. 1A, a high voltage is abruptly applied to the piezoelectric element 3 At time t=0, and the piezoelectric element 3 contracts. This state is held while the applied voltage keeps a constant value (in this case, about 85 V), and a free vibration of the piezoelectric element is suppressed. At an instance when the piezoelectric element 3 contracts, a portion with a high pressure (positive pressure portion) is formed, as shown in FIG. 19. Two positive pressure portions (regions 508 and 509) immediately become pressure waves, and propagate toward the ink supply port 6 and the ink injection or discharge opening or port 7 at a speed C, respectively. The pressure waves propagate as shown in FIG. 1B.

In FIG. 1B, d indicates that a positive pressure ½ ΔP of the region 9 propagates toward a nozzle 2, and e indicates that it has arrived at the ink injection port 7. At an instance of arrival, an ink liquid is injected outside the nozzle from the ink injection port 7, thus forming an ink drop 17. Thereafter, some positive pressure components are reflected by the ink injection port 7 and propagate toward the ink supply port 6, and then reciprocate between the ink supply port 6 and the ink injection port 7. This state is represented by f to j in FIG. 1B. This wave has given most of its wave energy provided from the piezoelectric element 3 at time t=0 to the ink drop 17, and the energy is small.

k in FIG. 1B indicates that the positive pressure of region 8 propagates toward the ink supply port 6, and this positive pressure arrives at the ink supply port 6 at time l. At the point l, reflection (reflection at an open end) occurs, and the positive pressure component becomes a portion (negative portion) having a lower pressure than Po (constant pressure of the ink within the ink chamber in the state of the head being stationary) and propagates toward the ink injection port 7 (wave m).

In this case, some wave components are fed to an ink sub tank (not shown) communicated with the ink supply port and the like. For this reason, the energy of reflected wave components propagating toward the ink injection port 7 arrives at the ink injection port 7 at a point n while being slightly weakened, and are again reflected thereby. Reflection at this time can be considered as that at a closed end, and hence, the negative pressure portion propagates toward the ink supply port 6 (o in FIG. 1B).

When the wave n is generated, if a distance between the ink supply port 6 and the ink injection port 7 is about 20 mm to 60 mm, the ink drop 17 tends to be connected to an ink in the ink pressure chamber. For this reason, the energy of the reflected negative portion is partially absorbed by the ink drop 17, and the reflected wave energy is slightly weakened and again reflected at a point p. In this case, since reflection at the open end of the ink supply port 6 occurs, the negative pressure portion is converted to the positive pressure portion (wave g).

If this positive pressure portion is left as it is, it may arrive at the ink injection port 7 and cause injection of a second ink drop which degrades image quality. If the second ink drop is injected, ink replenishment from an ink supply system (not shown) to a portion between the ink supply port 6 and the ink injection port 7 requires a considerable time, and may cause degradation of frequency characteristics.

Figure 21:
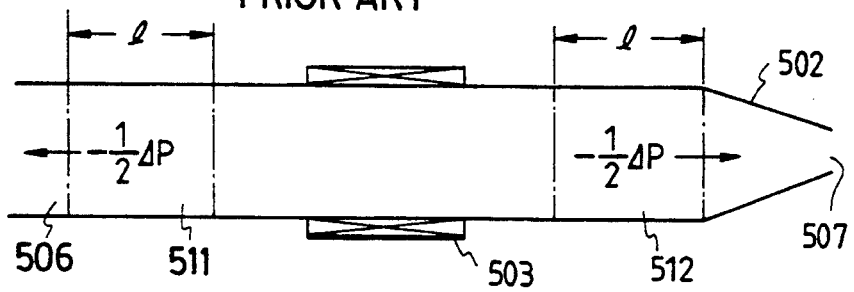
FIG. 21 PRIOR ART
Figure 22:
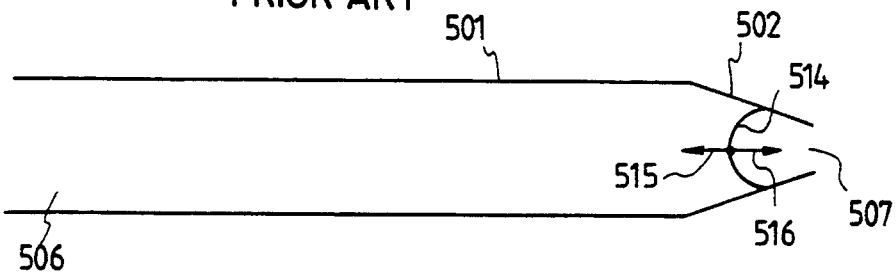
FIG. 22 PRIOR ART
Figure 23:
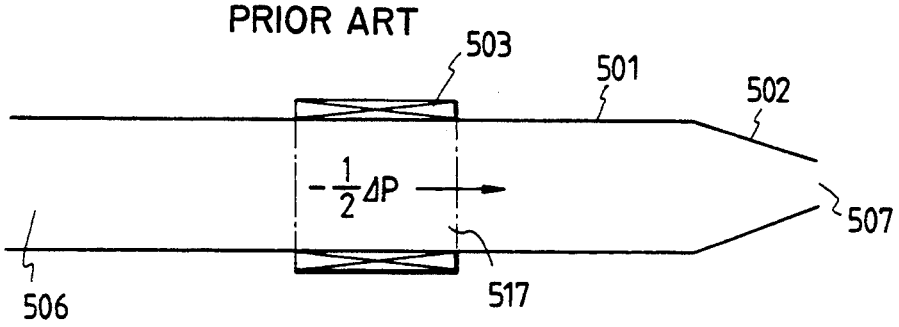
FIG. 23 PRIOR ART
Figure 24:
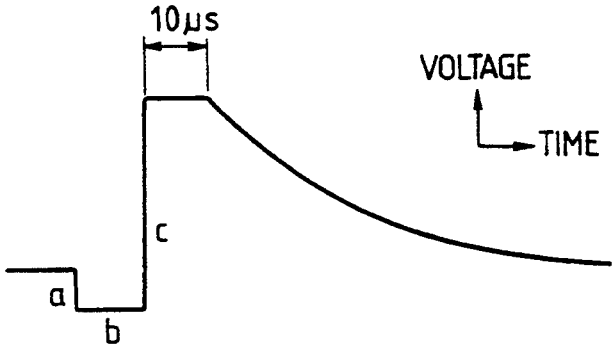
FIG. 24 PRIOR ART
FIG. 24 is a waveform chart of a conventional drive method.
Figure 25:
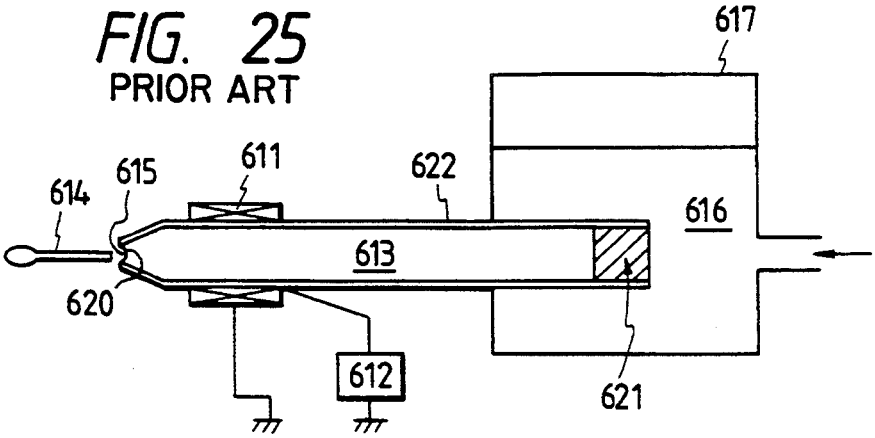
FIG. 25 PRIOR ART
FIG. 25 a sectional view showing a structure of a conventional ink-jet recording head.
Figure 26:
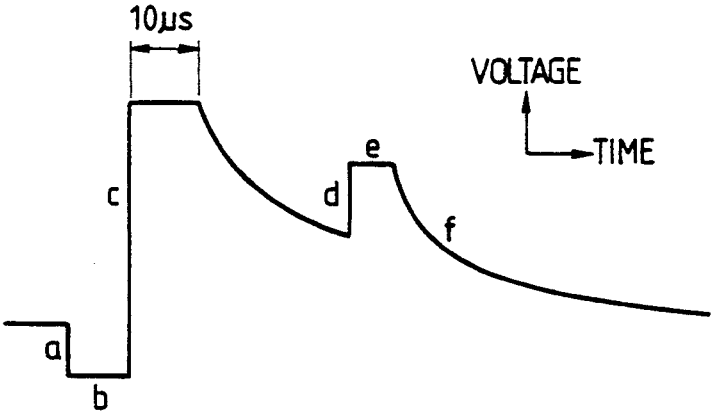
FIG. 26 PRIOR ART
FIG. 26 is a voltage waveform chart of another conventional drive method.

When the positive pressure portion passes inside the piezoelectric element 3 which timing corresponds to the timing when the positive pressure portion arrives at r, i.e., at time $2(l_1+2l_2)/C$ (where $l_1$ and $l_2$ are the distance from center portion of the piezoelectric element 3 to the ink injection port 7 and the supply port 6, respectively, are and C is the speed of the pressure wave in the ink pressure chamber), the drive voltage is decreased to cause the piezoelectric element 3 to expand, thereby generating negative pressure portions 511, 512 shown in FIG. 21. Of these portions, the negative pressure portion 512 overlaps the above-mentioned positive pressure portion 509. In this case, a decreased amount of the vomitage is selected to adjust the pressures of the newly generated two negative pressure portions, so that the positive and negative pressure portions cancel each other.

The drive voltage realizing this is that shown in FIG. 1A. A voltage drop portion y is not decreased or lowered to zero volts but to a given voltage value (in this embodiment, about 40 V) to suppress a decrease in pressure of the negative pressure portion to be newly generated- Every time the positive pressure portion reciprocates between the ink supply port 6 and the ink injection port 7 and is reflected thereby, the pressure difference with Po is decreased, and the pressure difference with Po is also decreased by a viscous resistance, internal resistance and the like of the ink itself. Therefore, in order to cancel the positive pressure portion, the voltage drop must be smaller than a leading voltage width of the drive voltage (in this embodiment, about 85 V). As a result, of the newly generated negative pressure portions, the negative pressure portion alone is a pressure wave left in the ink pressure chamber 1. This pressure wave is a wave s represented by a broken line in FIG. 1B, and propagates toward the ink supply port 6. The wave s is reflected at a point u to be converted to a positive pressure portion, and again propagates toward the ink injection port 7 as a wave v. This wave does not have energy enough to inject an ink drop.

After the drive voltage is decreased to a point z (FIG. 1A), it is gradually decreased to near zero volts. The reason why the voltage is slowly decreased is that if the applied voltage is immediately decreased, the piezoelectric element causes a complex vibration, and a pressure wave is accordingly generated in the ink pressure chamber 1. The reason why the drive voltage is made zero at once is that if the voltage at the point z is maintained, a drive voltage for the next ink injection cannot be applied. More specifically, if a distance between the ink supply port 6 and the ink injection port 7 is 18 mm or less, the voltage can be decreased to zero volts about 250 μs after the beginning of application of the drive voltage. This means that ink injection can be stably performed within a frequency range of zero to 4 kHz.

Figure 3:
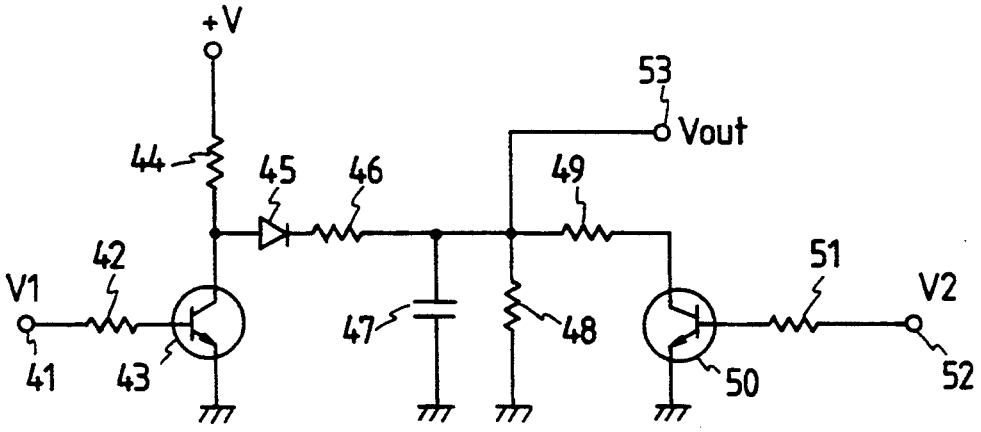
FIG. 3 is a circuit diagram showing in detail a driver 18 for generating the drive voltage shown in FIG. 1A.

FIG. 3 is a circuit diagram showing in detail the driver 18 for generating the drive voltage shown in FIG. 1A.

Figure 4A:
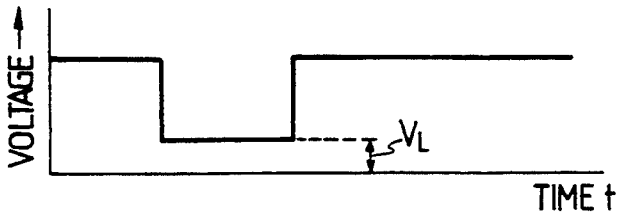
FIGS. 4A, 4B, and 4C are input and output voltage waveform charts of the circuit shown in FIG. 3.
Figure 4B:
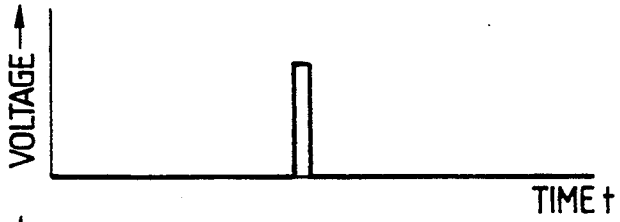
Figure 4C:
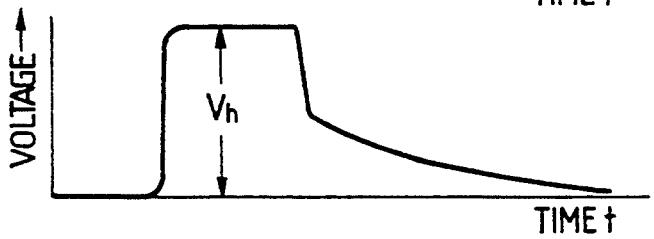

The driver 18 includes an input terminal 41 applied with a voltage shown in FIG. 4A, a resistor 42 one terminal of which is connected to the input terminal 41, a common-emitter npn transistor 43 the base of which is connected to the other terminal of the resistor 42, a resistor 44 inserted between a power supply +V and the collector of the transistor 43, a diode 45 the anode of which is connected to the collector of the transistor 43, a resistor 46 one terminal of which is connected to the cathode of the diode 45, a capacitor 47 connected between the other terminal of the resistor 46 and a ground potential, a resistor 48 connected in parallel with the capacitor 47, a resistor 49 one terminal of which is connected to the other terminal of the resister 46, a common-emitter npn transitor 50 the collector of which is connected to the other terminal of the resistor 49, a resistor 51 one terminal of which is connected to the base of the transistor 50, an input terminal 52 connected to the other terminal of the resistor 51 and applied with a voltage shown in FIG. 4B, and an output terminal 53.

In FIG. 3, when the voltage in FIG. 4B is applied to the input terminal 41, the transistor 43 in an 0N state is disabled in synchronism with the trailing edge of the voltage, a voltage appears at the collector of the transistor 43, and a charging current flows in the capacitor 47 through the diode 45 and the resistor 46. After the lapse of a predetermined period of time, when the voltage applied to the input terminal 41 goes to "H" level, the transistor 43 is disabled. At the same time, a pulse voltage having a waveform shown in FIG. 4B is applied to the input terminal 52, and the transistor 50 is enabled. When the transistor 50 is instantaneously enabled, the capacitor 47 is instantaneously discharged.

Charge from the capacitor 47 is no longer supplied to the transistor 43 since the transistor 50 is disabled and the diode 45 is connected to the transistor 43. Discharging is performed only through the resistor 48. Therefore, when the resistor 48 is appropriately selected, the time of the trailing edge portion can be determined. Note that the leading edge of the output waveform (drive voltage) is determined by the resistors 44 and 46, and the voltage width of an immediate voltage drop is determined by the pulse width in FIG. 4B. When the height VL of the lower peak of the voltage waveform shown in FIG. 4A is changed, the height Vh of a constant value portion in FIG. 4C can be adjusted, and hence, and ink injection amount can be adjusted.

Figure 5A:
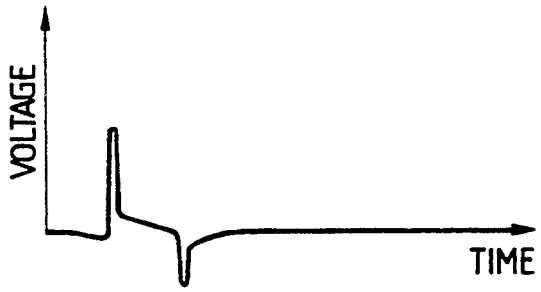
FIGS. 5A and 5B are respectively a drive voltage waveform chart and an element energization waveform chart for explaining another drive method.
Figure 5B:
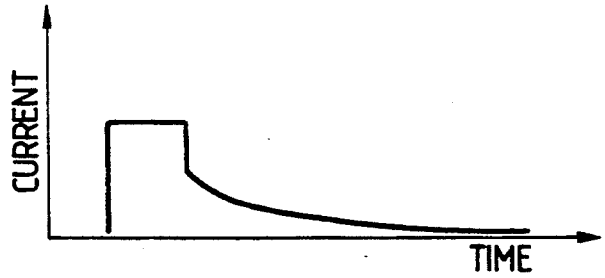

FIGS. 5A and 5B show drive voltage waveforms when a magnetostrictive element or the like having the nature of inductance is used as an electro-mechanical conversion element. A current shown in FIG. 5B immediately flows in the element by a positive first pulse voltage shown in FIG. 5A, and thereafter maintains a constant value state. Then, a negative second pulse voltage having a magnitude smaller than that of the first pulse voltage is applied, so that the current flowing through the magnetostrictive element is instantaneously decreased to a given level and then is slowly decreased. Note that a slow decrease in voltage between the first and second pulses shown in FIG. 5A is effective when an internal resistance of the element is not negligible.

Figure 6:
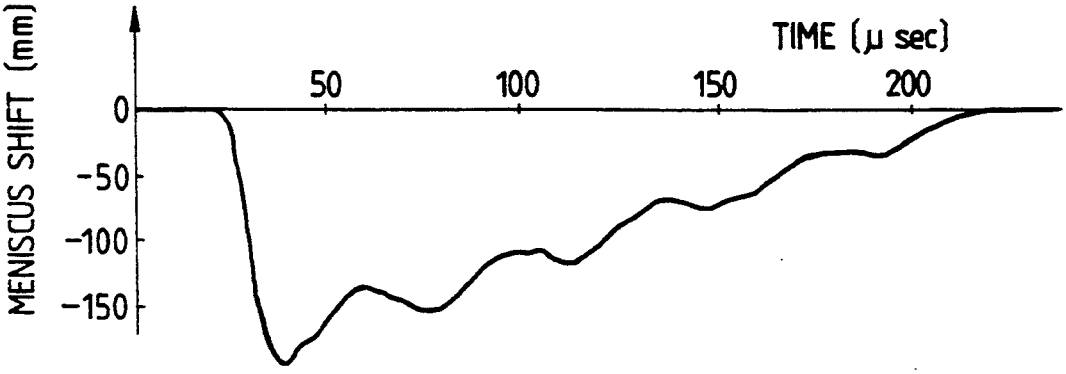
FIG. 6 is a graph showing a displacement of a meniscus in a nozzle after ink injection according to the present invention.

FIG. 6 shows measurement results of a displacement of a meniscus 14 after ink injection of a head having a 1.8-mm nozzle using the drive voltage of a waveform shown in FIG. 1A. As can be seen from FIG. 6, after one ink drop is injected, the meniscus 14 can be moderately returned to a balanced state without causing a vibration, and does not take in bubbles or the like in the discharge opening of the nozzle. Therefore, ink injection can be stably performed.

As described above, according to the first embodiment, the drive voltage is set to cause the electromechanical conversion element to immediately contract, hold the contracting state for a predetermined time period, cause the element to immediately expand to a given level, and gradually cancel the contracting state. Thus, one of two positive pressure portions caused upon application of the drive voltage is absorbed and canceled to effectively suppress the vibration of the meniscus, to quickly realize return to a balanced state, and to assure stable ink injection. Thus, image quality and frequency characteristics will not be degraded.

The drive voltages in the contraction and expansion modes of the converting element are set according to an ink injection amount and a contraction amount, so that an ink amount of an ink drop can be optimized, and a complex response of a pressure wave in an ink pressure path can be suppressed.

A contraction sustain time is set on the basis of a position of the electro-mechanical conversion element relative to the ink supply port and the ink injection port, so that a negative pressure caused by a change in drive voltage in the expansion mode is adjusted and can be canceled so as not to inject an unnecessary ink drop.

A second embodiment of the present invention will be explained hereinafter with reference to FIGS. 7 to 10.

Figure 7A:
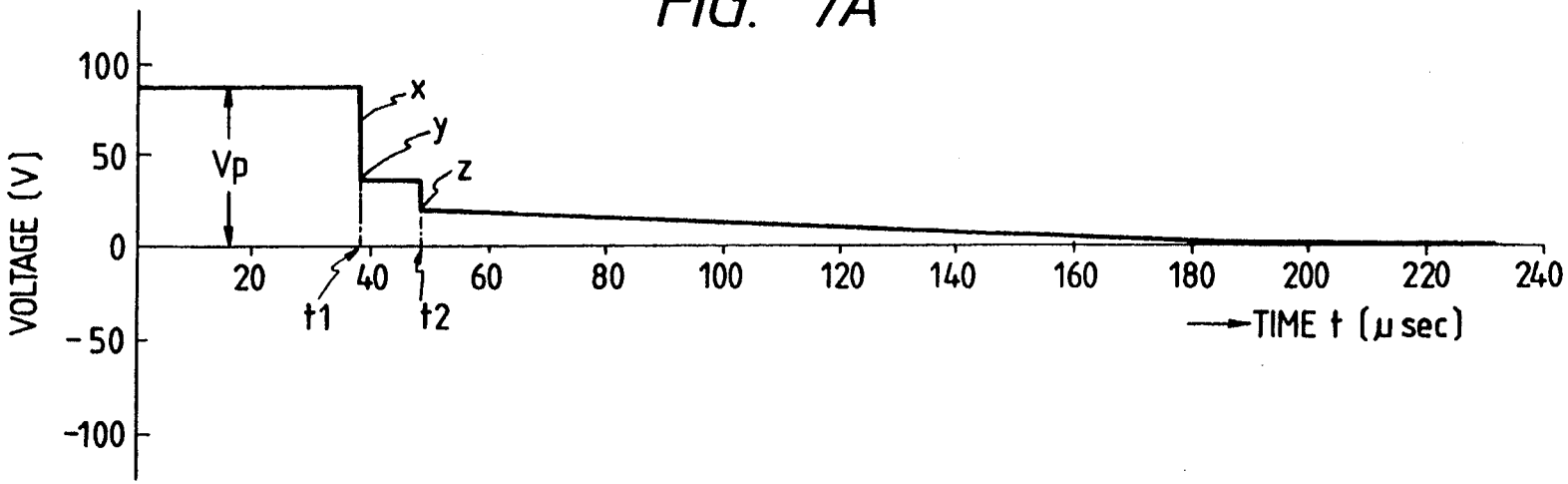
FIGS. 7A and 7B are respectively a graph showing time-voltage characteristics of a drive voltage for explaining a drive method according to the second embodiment, and a graph showing pressure wave propagation characteristics in an ink pressure chamber.
Figure 7B:
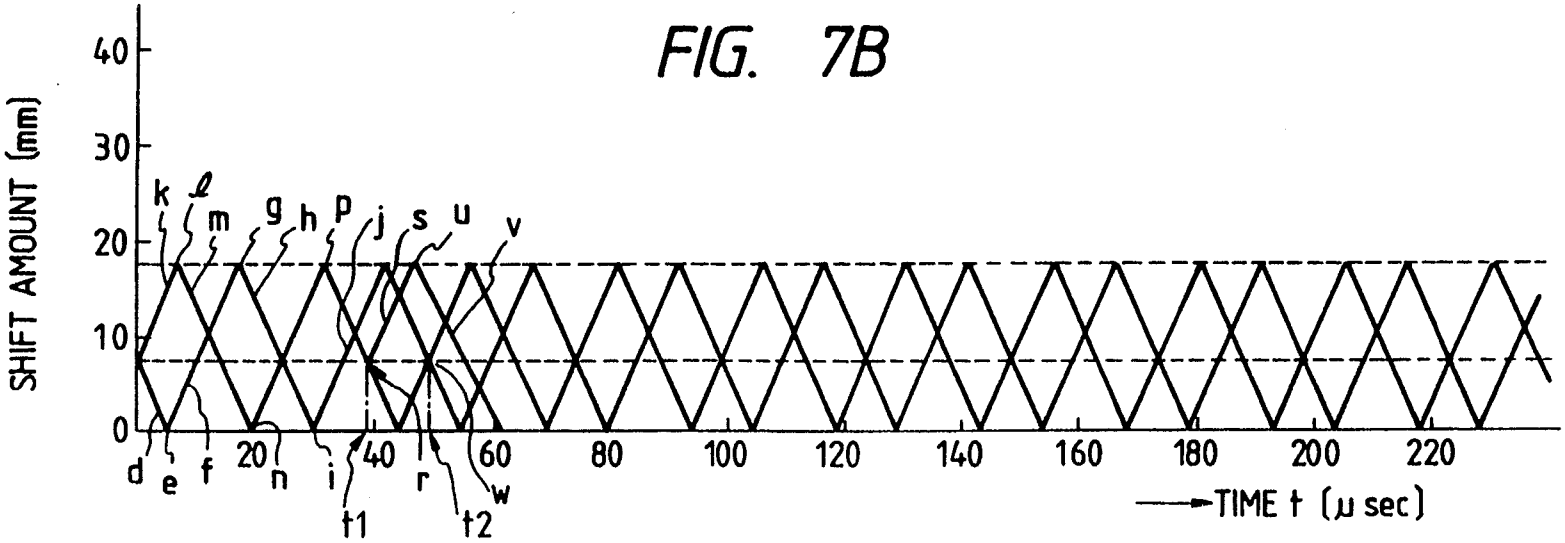

FIGS. 7A and 7B are respectively a graph showing time-voltage characteristics of a drive voltage for explaining a drive method according to the present invention, and a graph showing pressure wave propagation characteristics in an ink pressure chamber, which are somewhat different from that of the first embodiment of FIG. 1.

An ink head and a drive circuit of this embodiment are exactly the same as that of FIGS. 2 and 3 of the first embodiment, so explanation of them is omitted for simplicity.

In this embodiment, after the lapse of $t2=4(l_1+l_2)/C$ from the beginning of contraction of the piezoelectric element 3, the drive voltage is immediately decreased from the voltage y to a voltage z to cause a second expansion. Newly propagating-negative pressure portions are generated in the ink pressure chamber i by the voltage drop. One of these negative pressure portions serves to cancel the positive pressure of the region 9 associated with ink injection of the two positive pressure portions caused by an increase in voltage applied to the piezoelectric element 4 when t=0. Since this pressure wave has already caused an ink to injected and reciprocated several times in the ink pressure chamber 1, its energy is considerably weakened. Therefore, the voltage drop of the drive voltage applied to the piezoelectric element 3 applied at a point w need not be so large.

The widths of the two voltage drops shown in FIG. 7A should be proportional to a first applied voltage Vp. However, an optimal value must be appropriately selected in accordance with an ink viscosity and an ink temperature. Therefore, in some cases, the voltage z is not always zero volts.

In this case, as shown in FIG. 7A, the voltage is slowly decreased from voltage z to cause the ink pressure chamber 1 to gradually expand, so that a large pressure wave is not generated in the ink pressure chamber 1.

Figure 8A:
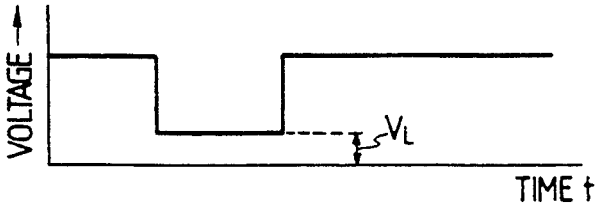
FIGS. 8A, 8B, and 8C are input and output voltage waveform charts of the circuit shown in FIG. 3.
Figure 8B:
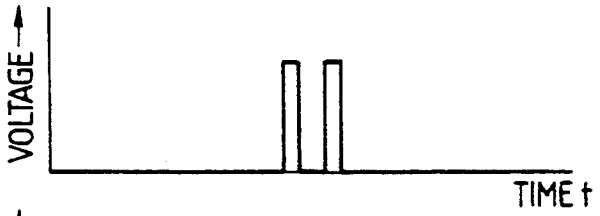
Figure 8C:
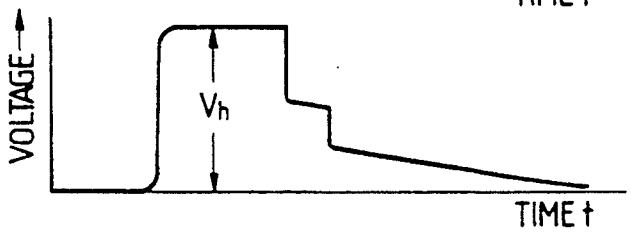

In FIG. 3, when the voltage in FIG. 8A is applied to the input terminal 41, the transistor 43 in an ON state is disabled in synchronism with the trailing edge of the voltage, a voltage appears at the collector of the transistor 43, and a charging current flows in the capacitor 47 through the diode 45 and the resistor After the lapse of a predetermined period of time, when the voltage applied to the input terminal 41 goes to "H" level, the transistor 43 is disabled. At the same time a pulse voltage having a waveform shown in FIG. 8B applied twice to the input terminal 52 at a given interval, and the transistor 50 is enabled. When the transistor 50 is instantaneously enabled twice, a charged on the capacitor 47 is instantaneously decreased in two steps.

Charge from the capacitor 47 is no longer supplied to the transistor 43 since the transistor 50 is disabled and the diode 45 is connected to the transistor 43. Discharging is performed only through the resistor Therefore, when the resistor 48 is appropriately selected, the time of a trailing edge portion can be determined. Note that the leading edge of the output waveform (drive voltage) is determined by the resistors 44 and 46, and the voltage width of an immediate voltage drop is determined by a pulse width in FIG. 8B. When the height VL of the lower peak of the voltage waveform shown in FIG. 8A is changed, the height Vh of a constant value portion in FIG. 8C can be adjusted, and hence, the ink injection Mount can be adjusted.

Figure 9A:
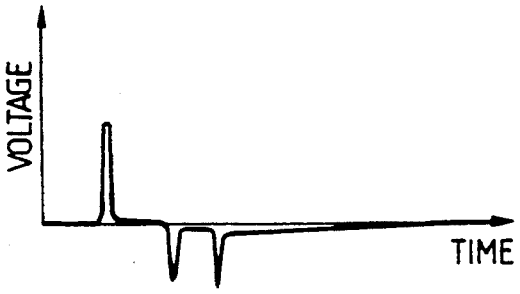
FIGS. 9A and 9B are respectively a drive voltage waveform chart and an element energization waveform chart for explaining another drive method.
Figure 9B:
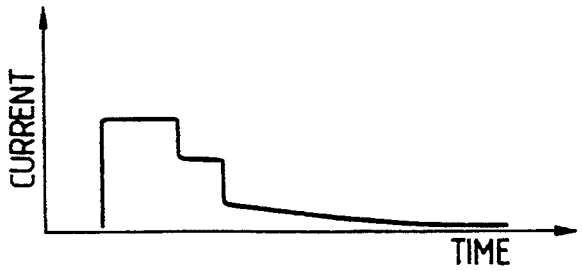

FIGS. 9A and 9B show drive voltage waveforms when a magnetostrictive element or the like having the nature of inductance is used as an electro-mechanical conversion element. A current shown in FIG. 5B immediately flows in an element by a positive first pulse voltage shown in FIG. 9A, and thereafter maintains a constant value state. Then, negative second and third pulse voltages each having a magnitude smaller than that of the first pulse voltage are sequentially applied, so that the current flowing through the element is instantaneously decreased in two steps to a given level and then is slowly decreased.

As described above, according to the second embodiment, the drive voltage is applied to an electro-mechanical conversion element and is made to cause an ink pressure chamber to immediately contract, holding the contracting state for a predetermined time period, cause the chamber to immediately expand stepwise to a given level so as to cancel the contracting state. Thus, one of two positive pressure portions caused upon application of the drive voltage is absorbed and canceled to effectively suppress a vibration of the meniscus, to quickly realize return to a balanced state, and to assure stable ink injection. As a result, image quality and frequency characteristics will not be degraded.

In addition to the stepwise expanding operation, the expanding state is moderately canceled, so that ink injection can be stably performed without causing a complex pressure wave in the ink pressure chamber. Furthermore, when the drive voltage in the expanding process is varied, the ink injection Mount can be adjusted.

When a plurality of expansion start timings are determined on the basis of the position of the electro-mechanical conversion element, a negative pressure in the ink pressure chamber can be adjusted and can be cancelled so as not to inject an ink drop, thus contributing to stabilization of ink injection.

A third embodiment of the present invention will now be described with reference to the accompanying drawings.

Figure 10:
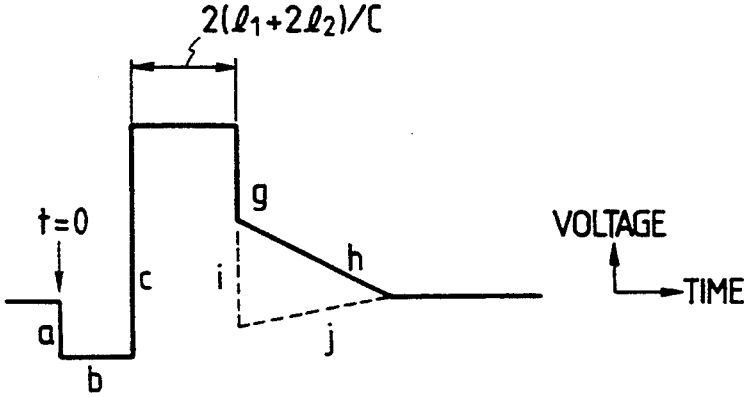
FIG. 10 is a voltage waveform chart of a third embodiment of the present invention.
Figure 11:
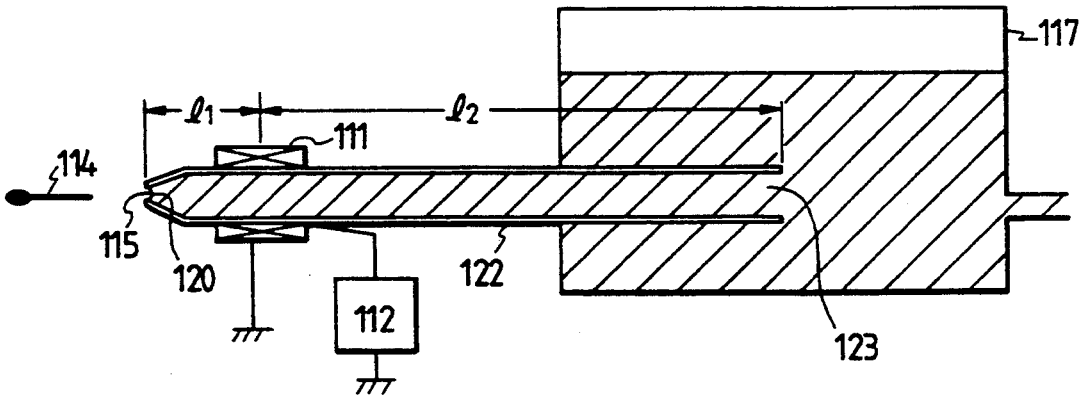
FIG. 11 is a sectional view showing an ink-jet recording head using this embodiment.

An ink-jet recording head shown in FIG. 11 is operated by a voltage waveform for driving an electro-mechanical conversion element 111, as shown in FIG. 10. In FIG. 11, a driver 112 drives the electro-mechanical conversion element 111. In FIG. an ink drop 114 is injected from an opening or orifice 115 of a glass tube 122, a rear end 123 of which is open to an ink tank 117 (a filter is not provided).

In FIG. 10, the electro-mechanical conversion element 111 immediately expands by an abrupt voltage drop a at time $t=0$, and an expanding state is maintained in a step b. During this interval, a meniscus 120 of the orifice 15 is slightly returned in an ink flow path.

Thereafter, the electro-mechanical conversion element 111 immediately contracts by an abrupt voltage increase C, and this state is maintained for a time interval of $2(l_1+2l_2)/C$. Note that $l_1$ indicates a distance from the center portion of electro-mechanical conversion element 111 to the orifice, at the distal end of an ink-liquid drop injection nozzle, $l_2$ indicates a distance from the center portion of element 111 to the rear end 123 of the glass tube 122, i.e., to an ink supply port, and C indicates a propagation speed of a pressure wave in the glass tube 122. During this time interval, the ink flies out from the opening 115, thus forming the ink drop 114.

After the lapse of the time interval $2(l_1+2l_2)/C$, the contracting state of the electro-mechanical conversion element 111 is immediately canceled in a step g, and thereafter, is gradually recovered to a state before operation in a step h. Thus, the meniscus 120 after injection of the ink drop 114 can be very smoothly recovered to a balanced state before injection without being roughly moved in the back-and-forth direction to the orifice 115, and neither injection of a second drop nor taking in of bubbles occurs.

The time interval $2(l_1+2l_2)/C$ is calculated as a time interval wherein a positive pressure wave (a higher pressure portion than a surrounding portion) propagating toward the rear end 123 of the glass tube 122 propagates toward the opening 115 as a negative pressure wave (a lower pressure portion than a surrounding portion), is directly reflected by the opening 115, reaches the rear end 123, is then reflected again as a positive pressure wave by the rear end 123, and reaches the electro-mechanical conversion element 111. Note that the opening 115 is acoustically regarded as a closed end, and the rear end 123 is acoustically regarded as an open end.

Figure 14:
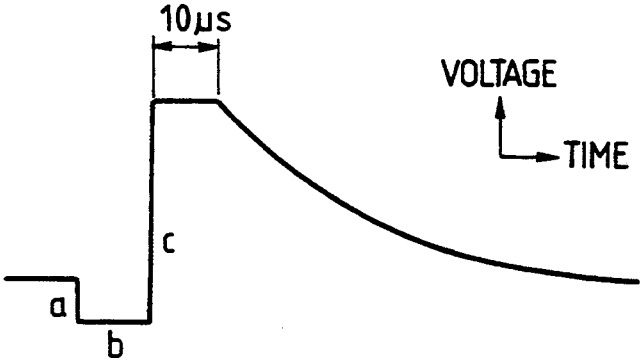
FIG. 14 is a voltage waveform chart of a conventional drive method.

After the lapse of the time interval, if a conventional drive method shown in FIG. 14 is employed without operating the element in the step g, the reflected pressure wave again reaches the opening 115 to cause a second ink drop to inject or bubbles are taken in upon movement of the meniscus although no ink drop is injected, thus disturbing the following injection.

Figure 13:
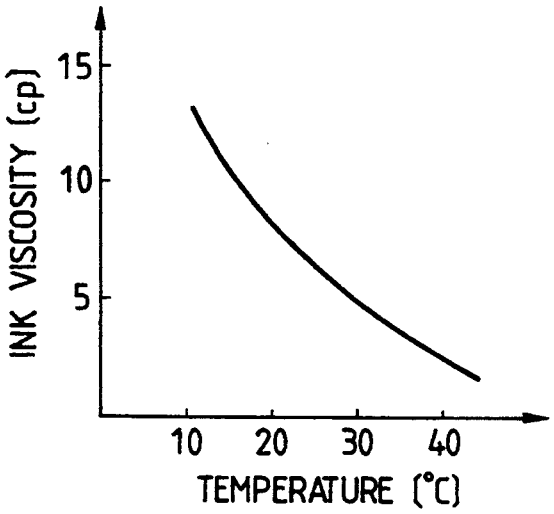
FIG. 13 is a graph showing the relationship between an ink viscosity and a temperature.

In this embodiment, the height of the step g can be smaller than that the step c. This is because the pressure wave propagating in the ink flow path while being reflected discharges part of its energy in the ink path upon reflection, and is attenuated by an internal friction (mainly caused by the viscosity of ink) as physical properties of the ink. Therefore, since the viscosity of the ink depends on temperature, as shown in FIG. 13, the ink temperature is detected by a temperature sensor so that the expansion necessary for canceling the energy of the reflected wave can only be given to the electro-mechanical conversion element 111 in consideration of the viscosity.

Since the height of the step g is smaller than that of step c, the element must be operated as in step h to recover the balanced state, so that no new pressure wave is generated in the ink flow path.

In step c, another positive pressure wave propagating toward the opening 115 is present. However, since this pressure wave reaches opening 115 and is absorbed as an energy for forming the ink drop 114. No reflected wave is formed, and the movement of the meniscus is not adversely influenced.

Figure 12A:
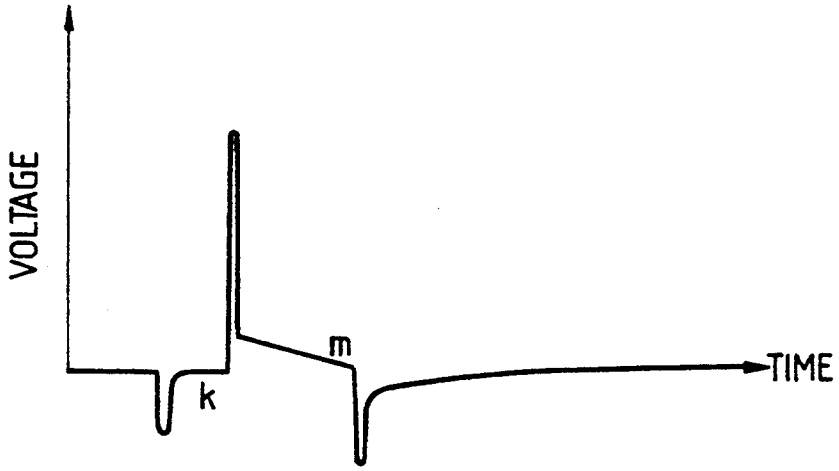
FIG. 12A is a voltage waveform chart of another embodiment of the present invention.
Figure 12B:
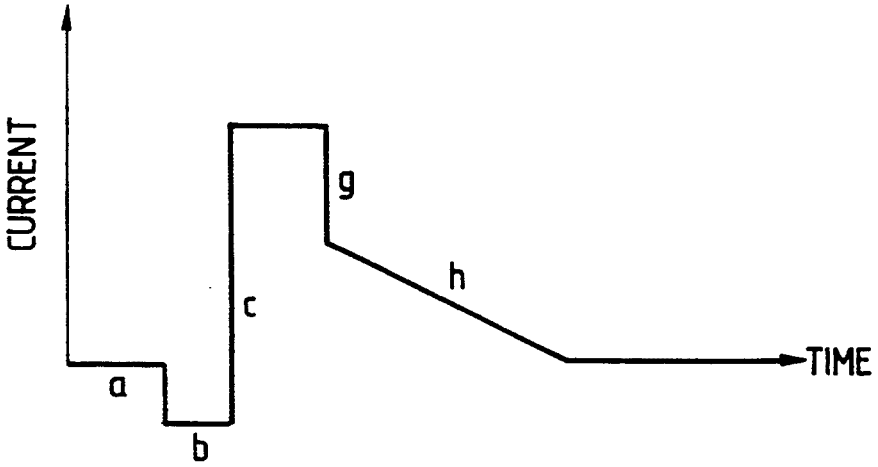
FIG. 12B is a current waveform chart of the embodiment shown in FIG. 12A.

FIG. 12A shows a voltage waveform, and FIG. 12B shows a current waveform in an embodiment wherein the electro-mechanical conversion element 111 is constituted by an inductive circuit element such as a magnetostrictive element, or the like.

The current waveform of FIG. 12B is formed by the steps a, b, c, g, and h, as in the above embodiment of FIG. 11, and a stable operation of the meniscus 120 can be assured. In the voltage waveform shown in FIG. 12A, moderate voltage gradients k and m are formed in consideration of the internal resistance of the electro-mechanical conversion element.

As described above, according to the third embodiment, since a reflected wave of a pressure wave propagating in an ink flow path is canceled, an ink-jet recording head which comprises no filter at the rear end of a glass tube constituting the ink flow path can be stably operated, and undesirable injection of a second ink drop for recording quality and taking in of bubbles can be prevented.

Additionally, since an electro-mechanical conversion element immediately expands by an amount corresponding to the ink temperature, stable ink injection can be assured over a wide temperature range.

Figure 15:
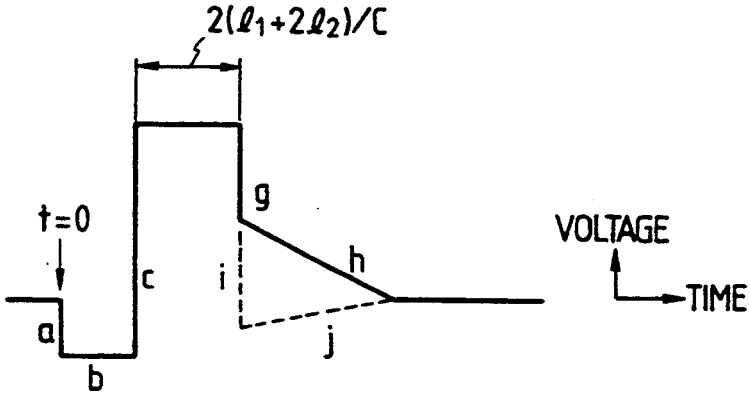
FIG. 15 is a voltage waveform chart of a fourth embodiment of the present invention.

A fourth embodiment of the present invention will now be described with reference to the accompanying drawings. An ink-jet recording head shown in FIG. 11 is operated by a voltage waveform for driving an electro-mechanical conversion element 111, as shown in FIG. 15.

The electro-mechanical conversion element 111 immediately expands by an abrupt voltage drop a at time $t=0$, and an expanding state is maintained in a step b. During this time interval, a meniscus 120 of the opening 115 is slightly returned in an ink path.

Thereafter, the electro-mechanical conversion element 111 immediately contracts by an abrupt voltage increase c, and this state is maintained for a time interval of $2(l_1+2l_2)/C$. During this time interval, the ink flies out from the opening 115, thus forming the ink drop 114

.

After the lapse of the time interval $2(l_1+2_2)/C$, the contracting state of the electro-mechanical conversion element 111 immediately expands in a step i, and thereafter, is gradually recovered to a state before operation in a step j. Thus, the meniscus 120 after injection of the ink drop 114 can be very smoothly recovered to a balanced state before injection without being roughly moved in the back-and-forth direction of the opening 115, and neither injection of a second drop nor taking in of bubbles from the discharge opening occurs.

After the lapse of the time interval, if a conventional drive method shown in FIG. 14 is employed without operating the element in the step i, the above mentioned disadvantage would occur.

In this embodiment, the height of the step i can be smaller than that of the step c. This is because the pressure wave propagating in the ink flow path while being reflected discharges part of its energy in the ink path upon reflection, and is attenuated by an internal friction (mainly caused by the viscosity of ink) as physical properties of the ink. Since the height of step i is smaller than that of the step c, the element must be operated as in step J to recover the balanced state, so that no new pressure wave is generated in the ink flow path.

In step c, another positive pressure wave propagating toward opening 115 is present. However, since this pressure wave reaches opening 115 and is absorbed as an energy for forming the ink drop 114, no reflected wave is formed, and the movement of the meniscus is not adversely influenced.

Figure 16A:
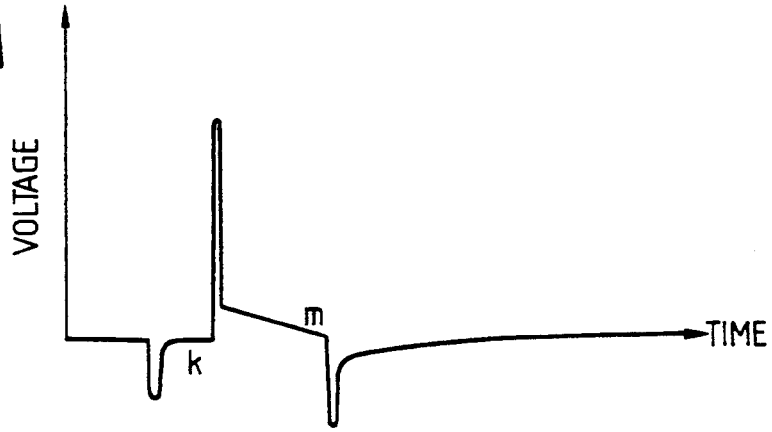
FIG. 16A is a voltage waveform chart of another embodiment of the present invention.
Figure 16B:
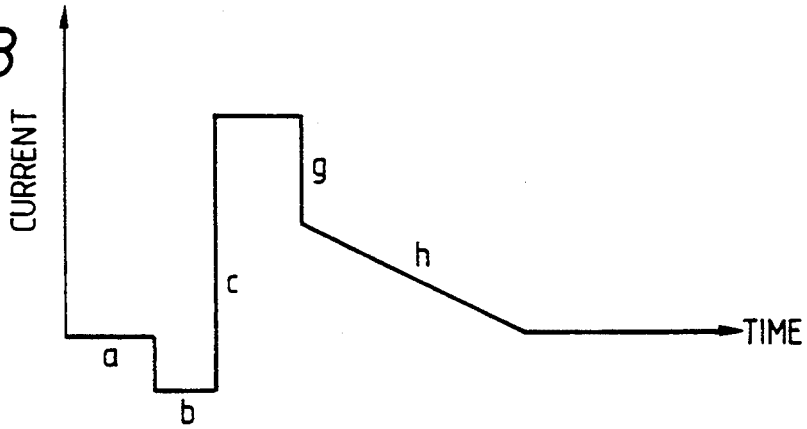
FIG. 16B is a current waveform chart of FIG. 16A.
Figure 17:
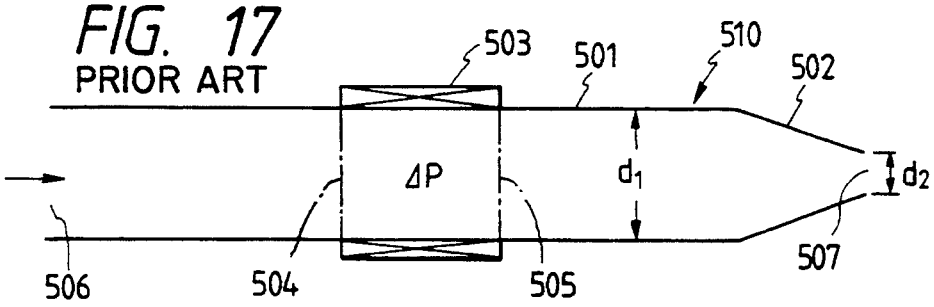
FIG. 17 PRIOR ART
FIG. 17 is a view for explaining the principle of discharge operation of an ink droplet.
Figure 18:
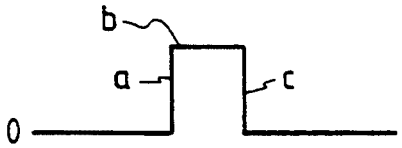
FIG. 18 PRIOR ART
FIG. 18 is a voltage waveform chart showing a conventional drivevoltage waveform.

FIG. 16A shows a voltage waveform, and FIG. 16B shows a current waveform applied to an embodiment wherein the electro-mechanical conversion element 111 is constituted by an inductive circuit element such as a magnetostrictive element, or the like.

The current waveform of FIG. 16B is formed by the steps a, b, c, i and j, as in FIG. 15, and a stable operation of the meniscus 120 can be assured. In the voltage waveform shown in FIG. 16, moderate voltage gradients k and m are formed in consideration of internal resistance of the electro-mechanical conversion element. That is, this embodiment is effective when the internal resistance is not negligible.

As described above, according to the fourth embodiment, since a reflected wave of a pressure wave propagating in an ink path is canceled, an ink-jet recording head which comprises no filter at the rear end of a glass tube constituting the ink path can be stable operated, and undesirable injection of a second ink drop and taking in of bubbles can be prevented.

Figure 27:
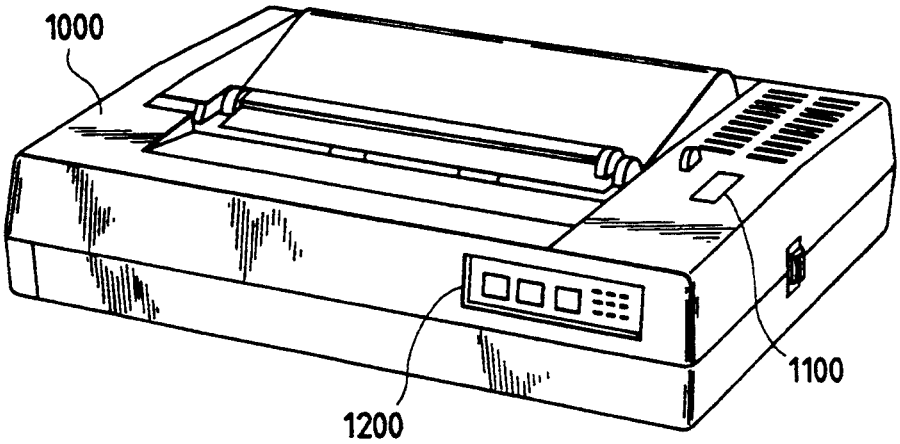
FIG. 27 is a perspective view of one example of a recording apparatus according to the present invention.

An outline of one example of the ink jet recording apparatus according to the present invention is disclosed in FIG. 27. In FIG. 27, numeral 1000 is a main body of the recording apparatus, 1100 is a power switch, and 1200 is an operation panel.

I claim:

1. An ink jet recording apparatus for recording with an ink jet head having an ink discharge opening for discharging ink therethrough, an ink chamber in communication with said ink discharge opening, a transducing element for decreasing the cross-sectional area of said ink chamber when a drive pulse is applied to said transducing element to cause ink in said ink chamber to be discharged from said ink discharge opening, said apparatus comprising a drive circuit for generating the drive pulse to apply same to said transducing element, wherein:

the drive pulse has a configuration including a (i) first portion when the pulse is abruptly increased from a base value to a first predetermined value in order to decrease said cross-sectional area of said ink chamber, the first portion being maintained at the first predetermined value for a predetermined time period, (ii) a second portion where the pulse is abruptly decreased to a second predetermined value greater than the base value and smaller than the first predetermined value, and (iii) a third portion where the pulse is gradually decreased from the second predetermined value, and the predetermined time period if at least $2(l_1+2l_2)/C$ (wherein $l_1$: the distance from the center of said transducing element to said ink discharge opening, $l_2$: the distance from the center of said transducing element to an ink feeding opening in said ink chamber, and C: the speed at which pressure is propagated through said ink chamber).

2. An ink jet recording apparatus according to claim 1, wherein the first predetermined value is variable to control the amount of ink discharged from said ink discharge opening.

3. An ink jet recording apparatus according to claim 1, wherein the second predetermined value is proportional to the first predetermined value.

4. An ink jet recording apparatus according to claim 1, wherein the gradual decrease in the drive pule from the second predetermined value further includes at least one abrupt decrease.

5. An ink jet recording apparatus according to claim 4, wherein the value of the drive pulse at the further abrupt decrease is variable.

6. An ink jet recording apparatus according to claim 4, wherein the abrupt decrease in the drive pulse occurs when a second predetermined time period has elapsed after the predetermined time period $$t1 = \frac{2(l_1 + l_2)}{C}, \; t2 = \frac{4(l_1 + l_2)}{C}$$

7. An ink jet recording apparatus according to claim 1, wherein the drive pulse further includes a preliminary portion comprising an abrupt decrease from the base value, after which the drive pulse is abruptly increased to the first predetermined value.

8. An ink jet recording apparatus according to claim 1, wherein said transducing element comprises an electro-mechanical transducer.

9. An ink jet recording apparatus according to claim 1, wherein said transducing element comprises a magnetostrictive element.

10. An ink jet recording apparatus according to claim 1, further comprising an ink jet recording head having an ink discharge for discharging ink therethrough, an ink chamber in communication with said ink discharge opening, a transducing element for decreasing the cross-sectional area of said ink chamber when a drive pulse is applied to said transducing element to cause ink in said ink chamber to be discharged from said ink discharge opening.

11. A method for preventing discharge of an unnecessary ink droplet in ink jet recording, said method comprising:

providing an ink jet head having an ink discharge opening for discharging ink therethrough, an ink chamber in communication with said ink discharge opening, a transducing element for decreasing the cross-sectional area of said ink chamber when a drive pule is applied to said transducing element to cause ink in said ink chamber to be discharged from said ink discharge opening; and generating a drive pulse and applying same to said transducing element, wherein the drive pulse has a configuration including (i) a first portion where the pulse is abruptly increased from a base value to a first predetermined value in order to decrease said cross-sectional area of said ink chamber, the first portion being maintained, at the first predetermined value for a predetermined time period, (ii) a second portion where the pulse is abruptly decreased to a second predetermined value greater than the base value and smaller than the first predetermined value, and (iii) a third portion where the pulse is gradually decreased from the second predetermined value, and wherein the predetermined time period is at least $2(l_1+2l_2)/c$ (where $l_1$: the distance from the center of said transducing element to said ink discharge opening, $l_2$: the distance from the center of said transducing element to an ink feeding opening in said ink chamber, and C: the speed at which pressure is propagated through said ink chamber).

12. An ink jet recording method according to claim 11, wherein the first predetermined value is variable to control the amount of ink discharged from said ink discharge opening.

13. An ink jet recording method according to claim 11, wherein the second predetermined value is proportional to the first predetermined value.

14. An ink jet recording method according to claim 11, wherein the gradual decrease in the drive pulse from the second predetermined value further includes at least one abrupt decrease.

15. An ink jet recording method according to claim 14, wherein the value of the drive pulse at the further abrupt decrease is variable.

16. An ink jet recording method according to claim 14, wherein the abrupt decrease in the drive pule occurs when a second predetermined time period has elapsed after the predetermined time period $$t1 = \frac{2(l_1 + l_2)}{C}, \; t2 = \frac{4(l_1 + l_2)}{C}$$

17. An ink jet recording method according to claim 11, wherein the drive pulse further includes a preliminary portion comprising an abrupt decrease from the base value, after which the drive pulse is abruptly increased to the first predetermined value.

18. An ink jet recording method according to claim 11, wherein said transducing element comprises an electro-mechanical transducer.

19. An ink jet recording method according to claim 11, wherein said transducing element comprises a magnetrostrictive element.

20. An ink jet recording method for preventing discharge of an unnecessary ink droplet in ink jet recording, said method comprising:

providing an ink jet head having an ink discharge opening for discharging ink therethrough, an ink chamber in communication with said ink discharge opening, a transducing element for decreasing the cross-sectional area of said ink chamber when a drive pulse is applied to said transducing element to cause ink in said ink chamber to be discharged from said ink discharge opening; and generating a drive pulse and applying same to said transducing element, wherein the drive pulse has a configuration including (i) a first portion where the pulse is abruptly increased from a base value to a first predetermined value in order to decrease said cross-sectional area of said ink chamber, the first portion begin maintained at the first predetermined value for a predetermined time period, (ii) a second portion where the pulse is abruptly decreased to a second predetermined value greater than the base value and smaller than the first predetermined value, and (iii) a third portion where the pulse is gradually decreased from the second predetermined value, and wherein the predetermined time period is at least $2(l_1+2l_2)/C$ (where $l_1$: the distance from the center of said transducing element to said ink discharge opening, $l_2$: the distance from the center of said transducing element to an ink feeding opening in said ink chamber, and C: the speed at which pressure is propagated through said ink chamber).

* * * * *

UNITED STATES PATENT AND TRADEMARK OFFICE

CERTIFICATE OF CORRECTION

PATENT NO. : 5,371,520

DATED : December 6, 1994

INVENTOR : HIDEMI KUBOTA

It is certified that errors appear in the above-identified patent and that said Letters Patent is hereby corrected as shown below:

ON THE TITLE PAGE:

[56] References Cited

U.S. PATENT DOCUMENTS, insert --4,313,684 2/1982 Tazaki .....346/140 X--.

COLUMN 1

Line 5, "continuation-in-part" should read --continuation--;

Line 27, "The" should read --the--; and

Line 28, "503. The" should read --503, the--.

COLUMN 2

Line 13, "Q" should read --1--;

Line 37, "the ." should read --the--; and

Line 46, "50?" should read --507--.

COLUMN 3

Line 56, "having" should be deleted.

COLUMN 4

Line 9, "on" should read --on- --; and

Line 23, "voltage" should read --voltage expand--.

UNITED STATES PATENT AND TRADEMARK OFFICE

CERTIFICATE OF CORRECTION

PATENT NO. : 5,371,520

DATED : December 6, 1994

INVENTOR : HIDEMI KUBOTA

It is certified that errors appear in the above-identified patent and that said Letters Patent is hereby corrected as shown below:

COLUMN 5

Line 51, "chamber:" should read --chamber;--; and

Line 55, "FIG. 1A:" should read --FIG. 1A;--.

COLUMN 6

Line 26, "drivevoltage" should read --drive voltage--;

Line 42, "FIGS. 1" should read --FIG. 1--;

Line 50, "piezolecstric" should read --piezoelectric--; and

Line 56, "At" should read --at--.

COLUMN 7

Line 55, "distance" should read --distances--;

Line 58, "are" should be deleted; and

Line 65, "vomitage" should read --voltage--.

COLUMN 8

Line 63, "ON" should read --ON--.

COLUMN 9

Line 20, "and" should read --the--.

UNITED STATES PATENT AND TRADEMARK OFFICE

CERTIFICATE OF CORRECTION

PATENT NO. : 5,371,520

DATED : December 6, 1994

INVENTOR : HIDEMI KUBOTA

It is certified that errors appear in the above-identified patent and that said Letters Patent is hereby corrected as shown below:

COLUMN 10

Line 19, "propagating-negative" should read --propagating negative--;

Line 20, "chamber i" should read --chamber 1--;

Line 26, "an ink to" should read --ink to be--;

Line 48, "resistor" should read --resistor 46.--;

Line 55, "charged" should read --charge--; and

Line 60, "resistor" should read --resistor 48.--.

COLUMN 11

Line 2, "Mount" should read --amount--;

Line 18, "holding" should read --hold--;

Line 24, "a" should be deleted; and

Line 33, "Mount" should read --amount--.

COLUMN 12

Line 34, "that the" should read --that of--;

Line 37, "an" should be deleted;

Line 41, "sensor" should read --sensor,--; and

Line 54, "an" should be deleted and "114. No" should read --114, no--.

UNITED STATES PATENT AND TRADEMARK OFFICE

CERTIFICATE OF CORRECTION

PATENT NO. : 5,371,520

DATED : December 6, 1994

INVENTOR : HIDEMI KUBOTA

It is certified that errors appear in the above-identified patent and that said Letters Patent is hereby corrected as shown below:

COLUMN 13

Line 28, "114" should read --114.--;

Line 30, "$2(l_1 + 2_2)/C$," should read --$2(l_1 + 2l_2)/C$,--;

Line 52, "step J" should read --step j--;

Line 57, "an" should be deleted; and

Line 68, "FIG. 16," should read --FIG. 16A,--.

COLUMN 14

Line 30, "a(i)" should read --(i) a--;

Line 43, "if" should read --is--;

Line 44, "(wherein" should read --(where--; and

Line 68, "period" should read --period.--.

COLUMN 15

Lines 2-3, " $\Omega = \frac{2(l_1 + l_2)}{C}, \Omega = \frac{4(l_1 + l_2)}{C}$ " should be deleted;

Line 19, "discharge" should read --discharge opening--;

Line 34, "pule" should read --pulse--;

UNITED STATES PATENT AND TRADEMARK OFFICE

CERTIFICATE OF CORRECTION

PATENT NO. : 5,371,520

DATED : December 6, 1994

INVENTOR : HIDEMI KUBOTA

It is certified that errors appear in the above-identified patent and that said Letters Patent is hereby corrected as shown below:

COLUMN 15, Cont'd.

Line 43, "maintained," should read --maintained--; and

Line 59, "An ink jet recording" should read --A--.

COLUMN 16

Line 1, "An ink jet recording" should read --A--;

Line 4, "An ink jet recording" should read --A--;

Line 8, "An ink jet recording" should read --A--;

Line 11, "An ink jet recording" should read --A--;

Line 12, "pule" should read --pulse--;

Line 14, "period" should read --period.--;

Lines 16-17, " $\Omega = \frac{2(l_1 + l_2)}{C}, \Omega = \frac{4(l_1 + l_2)}{C}$ " should be deleted;

Line 19, "An ink jet recording" should read --A--;

UNITED STATES PATENT AND TRADEMARK OFFICE

CERTIFICATE OF CORRECTION

PATENT NO. : 5,371,520

DATED : December 6, 1994

INVENTOR : HIDEMI KUBOTA

It is certified that errors appear in the above-identified patent and that said Letters Patent is hereby corrected as shown below:

COLUMN 16, Cont'd.

Line 24, "An ink jet recording" should read --A--; and

Line 27, "An ink jet recording" should read --A--.

Signed and Sealed this

Fourth Day of July, 1995

Bruce Lehman

*Attest:*

BRUCE LEHMAN

*Attesting Officer*

*Commissioner of Patents and Trademarks*